US007621471B2

(12) United States Patent
Howe

(10) Patent No.: US 7,621,471 B2
(45) Date of Patent: Nov. 24, 2009

(54) HIGH VOLTAGE MODULE WITH GAS DIELECTRIC MEDIUM OR VACUUM

(75) Inventor: Varce E. Howe, Zionsville, IN (US)

(73) Assignee: Illinois Tool Works Inc., Glenview, IL (US)

( * ) Notice: Subject to any disclaimer, the term of this patent is extended or adjusted under 35 U.S.C. 154(b) by 223 days.

(21) Appl. No.: 11/303,322

(22) Filed: Dec. 16, 2005

(65) Prior Publication Data

US 2007/0145167 A1 Jun. 28, 2007

(51) Int. Cl.
*B05B 5/00* (2006.01)

(52) U.S. Cl. ..... 239/690; 239/102.2; 239/525; 239/692; 239/704; 118/626; 361/228; 361/235; 363/61

(58) Field of Classification Search ..... 239/690–692, 239/704, 706, 707, 708, 290, 296, 525, 526, 239/102.2; 118/621, 626; 361/226–228, 361/335, 235; 363/61
See application file for complete search history.

(56) References Cited

U.S. PATENT DOCUMENTS 3,567,996 A 3/1971 Gordon et al.
3,608,823 A 9/1971 Buschor
3,651,354 A 3/1972 Cowan
3,673,463 A 6/1972 Gourdine
3,687,368 A 8/1972 Geberth, Jr.
3,731,145 A 5/1973 Senay
3,791,579 A 2/1974 Cowan
3,851,618 A 12/1974 Bentley
3,875,892 A 4/1975 Gregg et al.
3,889,042 A * 6/1975 Mears ..... 174/15.1
3,894,272 A 7/1975 Bentley
3,991,710 A 11/1976 Gourdine et al.
4,020,393 A 4/1977 Porter
4,075,677 A 2/1978 Bentley
4,120,017 A * 10/1978 Sickles ..... 361/228
4,165,022 A 8/1979 Bentley et al.
4,187,527 A 2/1980 Bentley
4,219,865 A 8/1980 Malcolm
4,248,386 A 2/1981 Morle
4,258,409 A 3/1981 Porter
4,287,552 A * 9/1981 Wagner et al. ..... 361/228
4,290,091 A 9/1981 Malcolm
4,324,812 A 4/1982 Bentley
4,331,298 A 5/1982 Bentley et al.
4,433,003 A 2/1984 Gourdine
4,481,557 A 11/1984 Woodruff
4,485,427 A 11/1984 Woodruff et al.
4,491,276 A * 1/1985 Reeves ..... 239/692
4,498,631 A 2/1985 Gourdine
4,508,276 A 4/1985 Malcolm
4,529,131 A 7/1985 Rutz
4,574,092 A 3/1986 Gourdine
4,745,520 A 5/1988 Hughey (Continued)

FOREIGN PATENT DOCUMENTS

EP 0405126 1/1991

(Continued)

OTHER PUBLICATIONS

International Search Report for International Application No. PCT/US2006/044383, Jun. 18, 2007, 10 pgs.

*Primary Examiner*—Steven J Ganey
(74) *Attorney, Agent, or Firm*—Barnes & Thornburg LLP

(57) ABSTRACT

An electrostatic spray gun includes a power supply, an enclosure having a wall and a valve providing access through the wall to evacuate the enclosure. Components of the power supply are housed in the enclosure and subject to the atmosphere within the enclosure.

11 Claims, 3 Drawing Sheets

U.S. PATENT DOCUMENTS

| | | | | |
|---|---|---|---|---|
| 4,747,546 | A | 5/1988 | Talacko | |
| 4,911,367 | A | 3/1990 | Lasley | |
| 4,934,603 | A | 6/1990 | Lasley | |
| 4,934,607 | A | 6/1990 | Lasley | |
| 4,993,645 | A | 2/1991 | Buschor | |
| 5,022,590 | A | 6/1991 | Buschor | |
| D318,712 | S | 7/1991 | Buschor | |
| 5,063,350 | A | 11/1991 | Hemming et al. | |
| 5,067,434 | A | 11/1991 | Thur et al. | |
| D325,241 | S | 4/1992 | Buschor | |
| 5,159,544 | A | 10/1992 | Hughey et al. | |
| 5,178,330 | A | 1/1993 | Rodgers | |
| 5,218,305 | A * | 6/1993 | Lunzer | 239/690 |
| 5,604,352 | A * | 2/1997 | Schuetz | 363/61 |
| 5,678,770 | A * | 10/1997 | Shah | 239/690 |
| 5,972,417 | A * | 10/1999 | Perkins et al. | 239/708 |
| 5,978,244 | A | 11/1999 | Hughey | |
| 6,144,570 | A | 11/2000 | Hughey | |
| 6,276,616 | B1 | 8/2001 | Jenkins | |
| 6,423,142 | B1 | 7/2002 | Hughey | |
| 6,460,787 | B1 | 10/2002 | Hartle et al. | |
| 6,562,137 | B2 | 5/2003 | Hughey | |
| 2003/0006322 | A1 | 1/2003 | Hartle et al. | |

FOREIGN PATENT DOCUMENTS

| | | |
|---|---|---|
| GB | 1 387 632 | 3/1975 |

* cited by examiner

HIGH VOLTAGE MODULE WITH GAS DIELECTRIC MEDIUM OR VACUUM

FIELD OF THE INVENTION

This invention relates to coating dispensing apparatus (hereinafter sometimes "spray guns" or "guns") for electrostatically aided atomization and dispensing of coating materials, and particularly to high magnitude potential generators for such guns.

BACKGROUND OF THE INVENTION

Various different types of spray guns having in-gun high magnitude potential generators are known. There are, for example, the manual spray guns illustrated and described in the following listed U.S. Pat. Nos. and published applications: 2003/0006322; 6,460,787; 6,276,616; 5,178,330; D325,241; D318,712; 5,022,590; 4,993,645; 4,934,607; 4,934,603; 4,911,367; 4,747,546; 4,574,092; 4,529,131; 4,508,276; 4,498,631; 4,433,003; 4,331,298; 4,290,091; 4,258,409; 4,248,386; 4,219,865; 4,165,022; 4,020,393; 3,991,710; 3,791,579; 3,731,145; 3,687,368; 3,673,463; 3,651,354; and, 3,608,823; and British Patent 1,387,632. Reference is here also made to U.S. Pat. Nos. 6,562,137; 6,423,142; 6,144,570; 5,978,244; 5,159,544; 4,745,520; 4,485,427; 4,481,557; 4,324,812; 4,187,527; 4,075,677; 3,894,272; 3,875,892; 3,851,618; and, 3,567,996. Reference is also made to U.S. Ser. No. 11/153,989 filed Jun. 16, 2005, titled In-Gun Power Supply Control, and assigned to the same assignee as this application. The disclosures of these references are hereby incorporated herein by reference. This listing is not intended to be a representation that a complete search of all relevant art has been made, or that no more pertinent art than that listed exists, or that the listed art is material to patentability. Nor should any such representation be inferred.

DISCLOSURE OF THE INVENTION

According to an aspect of the invention, a combination includes a power supply and an enclosure for housing the power supply. The enclosure has a wall and a valve providing access through the wall to evacuate the enclosure. The components of the power supply are subject to the atmosphere within the enclosure.

According to another aspect of the invention, the power supply and enclosure are incorporated into an electrostatic spray gun.

Illustratively according to the invention, the power supply is selected from the group of power supplies including electrogasdynamic supplies, supplies including gas turbine driven generators or alternators, supplies including piezoelectric generators, supplies including triboelectric generators, such as Van de Graaff generators, supplies including transformers for transforming AC line voltage variations and multipliers, and supplies including a low voltage DC supply, an inverter, a transformer and a multiplier.

Illustratively according to the invention, the power supply comprises a supply including a transformer and a multiplier.

Illustratively according to the invention, the components of the power supply which are housed in the enclosure include the multiplier.

Further illustratively according to the invention, the apparatus includes a high dielectric constant gas or mixture of gases. The gas or mixture of gases is introduced into the enclosure after evacuation of the enclosure.

Illustratively according to the invention, the high dielectric constant gas or mixture of gases comprises sulfur hexafluoride.

Illustratively according to the invention, the electrostatic spray gun comprises a somewhat pistol grip-shaped handle and a barrel extending from the handle, the enclosure forming at least a part of the barrel.

BRIEF DESCRIPTION OF THE DRAWINGS

The invention may best be understood by referring to the following detailed description and accompanying drawings which illustrate the invention. In the drawings.

DETAILED DESCRIPTIONS OF ILLUSTRATIVE EMBODIMENTS

Figure 3:
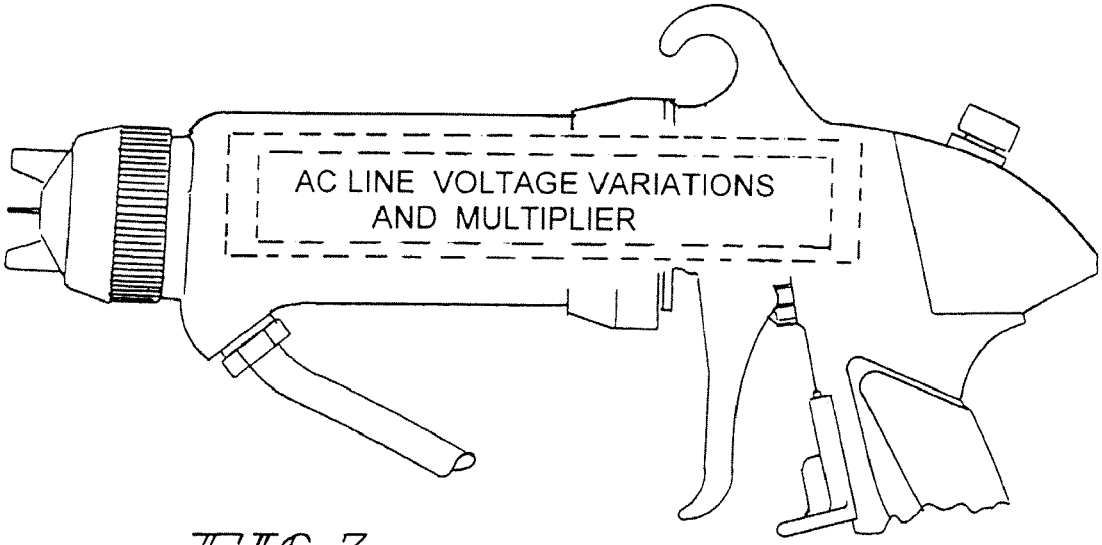
FIG. 3 illustrates a side elevational view of another spray gun constructed according to the present invention.
Figure 4:
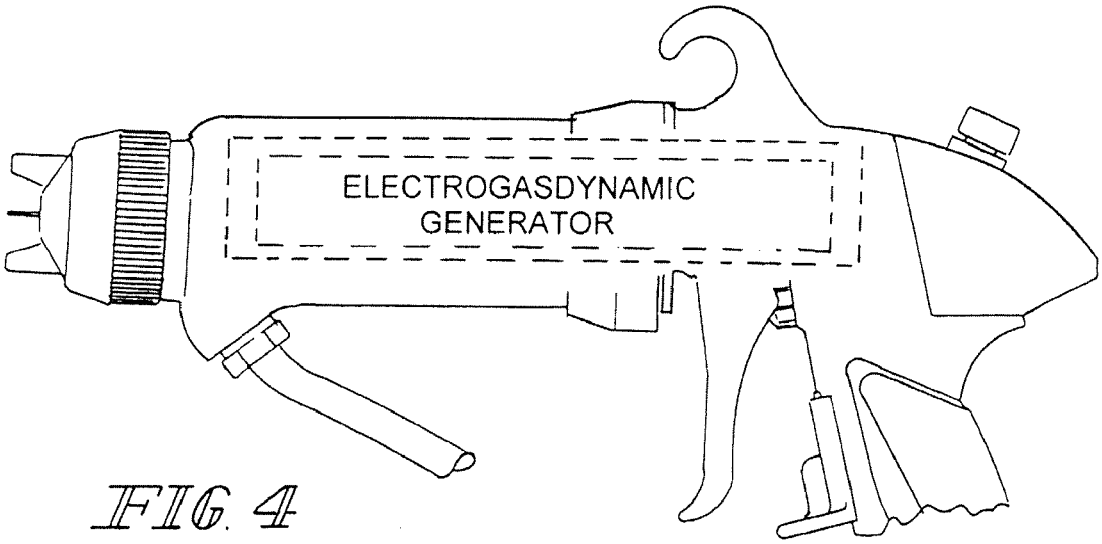
FIG. 4 illustrates a side elevational view of another spray gun constructed according to the present invention.
Figure 5:
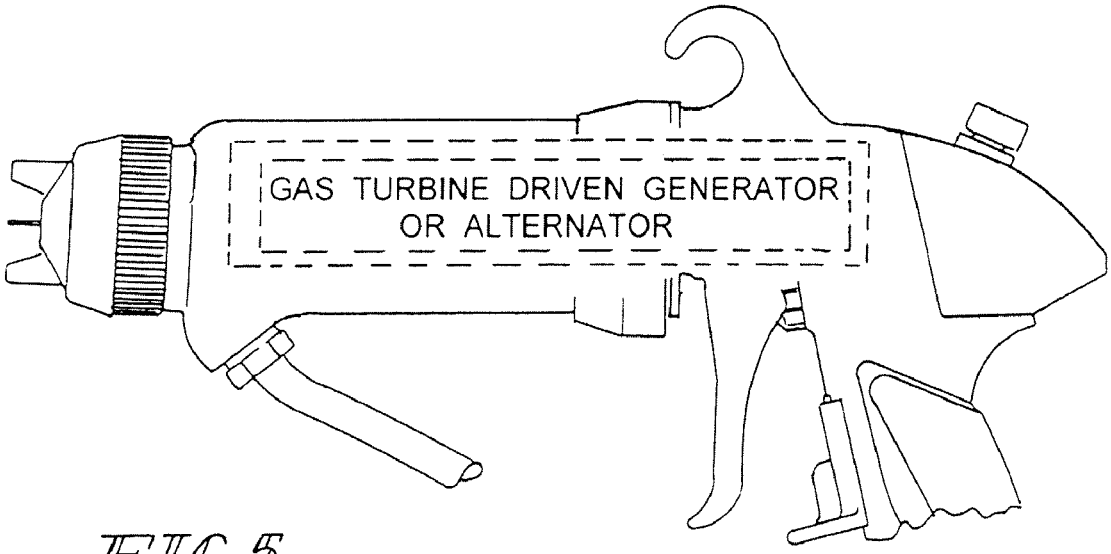
FIG. 5 illustrates a side elevational view of another spray gun constructed according to the present invention.
Figure 6:
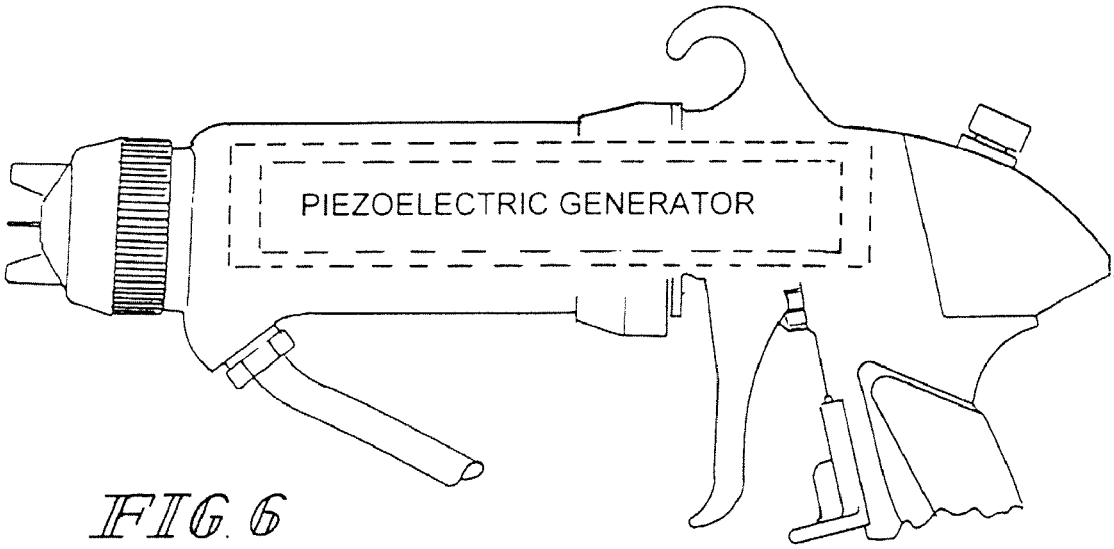
FIG. 6 illustrates a side elevational view of another spray gun constructed according to the present invention.
Figure 7:
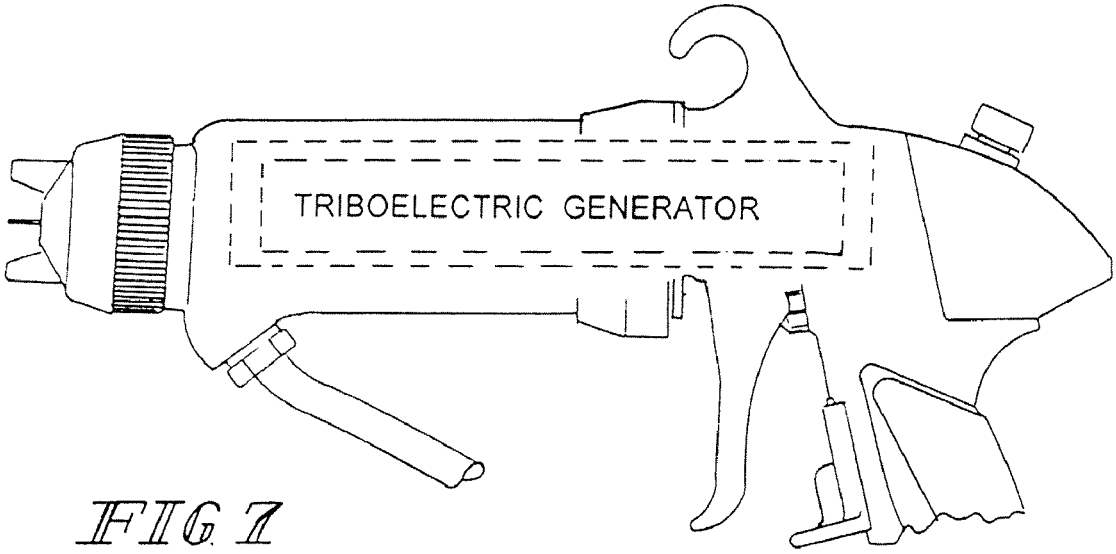
FIG. 7 illustrates a side elevational view of another spray gun constructed according to the present invention; and, FIG. 8 illustrates a fragmentary diagrammatic highly fragmentary side elevational view illustrating certain steps in the construction of a spray gun of the type illustrated in FIGS. 1-7.

The invention can be adapted for use with any of a number of different power supplies and power supply configurations. By way of example, but certainly not by way of limitation, these include: AC line supply/transformer/multiplier and internal (for example, battery) or external low voltage DC supply/inverter/transformer/multiplier supplies of the general types illustrated and described in the above referenced U.S. Pat. Nos. 4,331,298, 4,165,022, 3,731,145, 3,687,368, and 3,608,823, and U.S. Ser. No. 11/153,989 (see FIGS. 1-3); electrogasdynamic supplies of the general type illustrated and described in the above referenced U.S. Pat. Nos. 4,574,092, 4,498,631, 4,433,003, 4,020,393, 3,991,710, 3,791,579, 3,673,463, and 3,651,354 (see FIG. 4); gas turbine driven generator/inverter/transformer/multiplier supplies and alternator/transformer/multiplier supplies of the general types illustrated and described in the above referenced U.S. Pat. Nos. 4,290,091 and 4,219,865 (see FIG. 5); piezoelectric supplies of the general type illustrated and described in the above referenced U.S. Pat. No. 4,248,386 (see FIG. 6); and, triboelectric generators such as, for example, Van de Graaff generators of the general type illustrated and described in the above referenced British Pat. No. 1,387,632 (see FIG. 7).

Figures 1, 2:
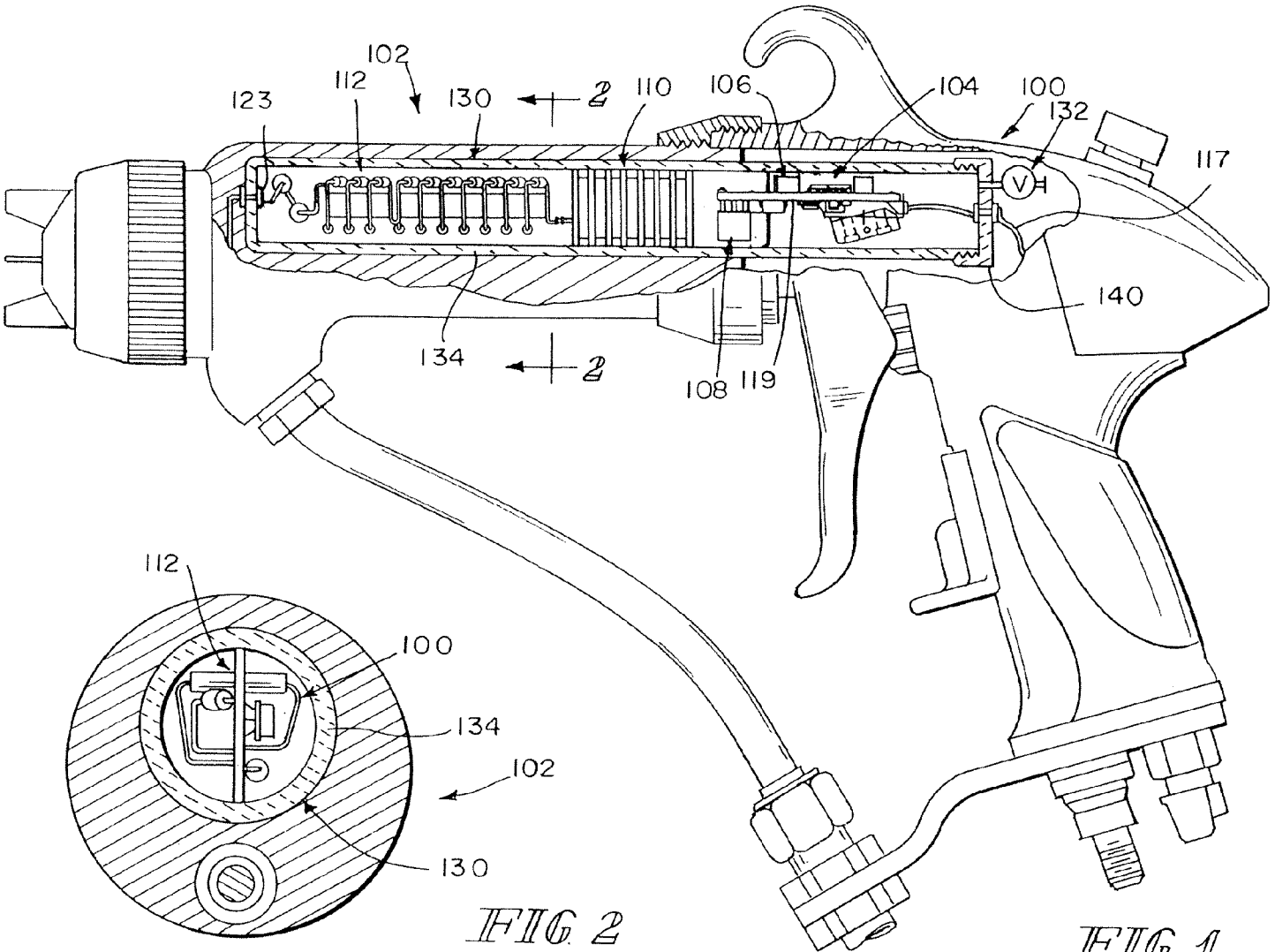
FIG. 1 illustrates a partly fragmentary side elevational view of a spray gun constructed according to the present invention.
FIG. 2 illustrates a sectional view of the spray gun illustrated in FIG. 1, taken generally along section lines 2-2 of FIG. 1.

Without any intention to be limited in the types of power supplies to which the present invention can be adapted, the invention will be described in connection with an external low voltage DC supply/inverter/transformer/multiplier supply of the type illustrated and described in the above referenced U.S. Ser. No. 11/153,989. Referring now particularly to FIG. 1, a power supply 100 for an electrostatic spray gun 102 includes an oscillator circuit 104, a driver circuit 106, (a) switch(es)

108, a transformer 110, and a voltage multiplier 112. Components 104, 106 and 108 may be mounted on a PC board 119.

An externally generated low DC voltage of, for example, ≦24 VDC, provided on a conductor 117 is converted by oscillator circuit 104, driver circuit 106 and switch(es) 108 to an AC signal across a primary winding of transformer 110. The transformer 110 produces across its secondary windings an AC voltage of, for example, 5 KV that is then rectified and multiplied in voltage multiplier 112 to provide at an output terminal 123 of voltage multiplier 112 a voltage suitable for efficient electrostatic application of coating material, for example, negative 60-90 KV DC. The high voltage generator circuit must be made as small and lightweight as possible to facilitate manipulation of the hand-held electrostatic spray gun 102 in which it is mounted. The components of power supply 100 must therefore be placed extremely close together. This raises the possibility of electrical breakdown. Heretofore, it was common practice to pot certain elements of this assembly, for example, PC board 119 and components 110 and 112, using high dielectric strength potting compound in order to provide dielectric insulation for certain components of the power supply 100. The potting compounds, when cured, exhibit dielectric strengths in the 400-500 volts/mil (about 15.7 KV/mm about 19.7 KV/mm) range, which is suitable to protect against dielectric breakdown between components at different electrical potentials, assuming that special components and manufacturing techniques are observed and that care is taken in the design of the assembly.

Figure 8:
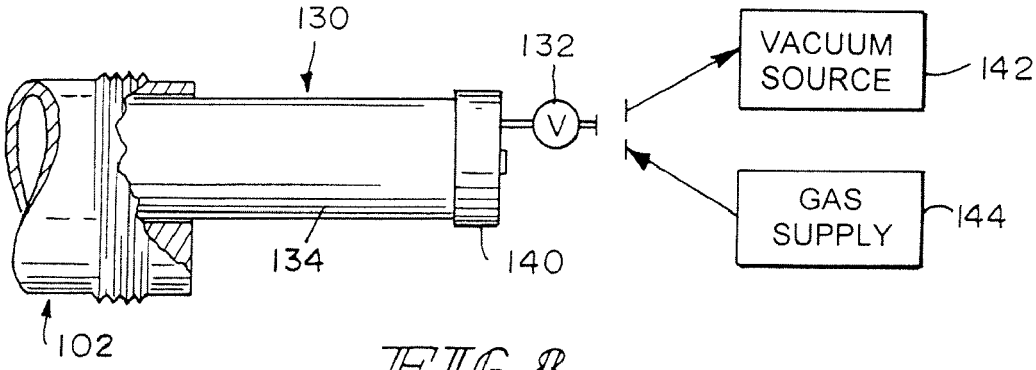

According to a first illustrated embodiment, PC board 119 and components 104, 106, 108, 110 and 112 that previously would have been potted with potting compound are mounted in a vessel 130 of generally right circular cylindrical configuration. The vessel 130 is closed by flat, part-spherical, or other suitable configuration ends. The configurations of the vessel 130 sidewall(s) and ends need be such as to provide the necessary strength to withstand evacuation and optionally pressurization. Referring now particularly to FIGS. 1 and 8, the vessel 130 containing the components 104, 106, 108, 110, 112, 119 is evacuated by coupling it to a vacuum source 142 through a valve 132 provided in end closure cap 140 of vessel 130 down to a pressure of, for example, a few millibars to a few tens of millibars. A relatively high dielectric strength gas, such as sulfur hexafluoride ($SF_6$), hydrogen or any other suitably high dielectric strength gas is then introduced from a source 144 through valve 132. Such gases are typically used by themselves or as part of proprietary mixtures by manufacturers of high voltage relays and are pressurized to several atmospheres. See, for example, http://relays.tycoelectronics.com/kilovac/ and http://www.gigavac.com/. Dielectric strengths for such gas mixtures can approach the dielectric strength of a vacuum. Life-limiting dielectric breakdown of the potting compound that previously would have encased at least some of the components 104, 106, 108, 110, 112, 119 housed in vessel 130 is thus avoided.

High voltage arcing is initiated by ionization of an insulating medium. A vacuum represents the absence of any ionizable insulating medium. Therefore, according to another embodiment, the vessel 130 containing one or more of the components 104, 106, 108, 110, 112, 119 that previously would have been potted with potting compound is evacuated from source 142 through its valve 132 down to a few millibars and the valve 132 is then closed to maintain the atmosphere inside vessel 130 at relatively high vacuum. A thus-evacuated vessel 130 can provide up to 2,000 volts per 0.001 inch (2,000 volts/mil) (about 79 KV/mm) dielectric strength.

Vessel 130 and its end closure cap 140 are constructed from any suitable material. Materials that are highly gas-impermeable and will not outgas significantly are preferred because they will not contribute leaked and/or outgassed components, such as volatile organic solvents, plasticizers and the like, back into the atmosphere inside vessel 130 once it is pumped down to relatively high vacuum, whether or not it is then repressurized with high dielectric strength gas. Such materials include certain ceramics, certain glasses, and certain very rigid resins and polymers. In the illustrated embodiment, a circuit board 146 on which components of high voltage multiplier 112 are mounted also functions as a spacer or standoff for component 112 and any of components 104, 106, 108, 110 that are mounted to it. Alternatively, one or more spacers constructed from, for example, the same or similar materials as vessel 130 can be placed around the components 104, 106, 108, 110, 112, 119 that are placed into the vessel 130 to maintain relatively uniform spacing between the components 104, 106, 108, 110, 112, 119 and the vessel 130 sidewall(s) 134.

Potted high magnitude power supply components typically require special fabrication processes to maximize adhesion of the potting compound to component surfaces. Component spacing and special soldering techniques must also be observed in order to reduce the occurrence of high dielectric stress points which would promote electrical breakdowns and discharges to adjacent components. Many potting compounds currently in use are susceptible to thermal stress which also calls for precise fabrication techniques. Use of the evacuated vessel 130 or vessel 130 evacuated and then repressurized with higher dielectric strength gas reduces or eliminates potting processes and associated manufacturing complexities and enhances reliability.

Use of the evacuated vessel 130 or vessel 130 evacuated and then repressurized with higher dielectric strength gas also reduces the weight of the power supply 100 and therefore the overall weight of the gun 102. This reduces operator fatigue, makes the gun 102 more maneuverable, and so on.

What is claimed is:

1. An electrostatic spray gun including a power supply, an enclosure having a wall, a valve providing access through the wall, the enclosure being evacuated through the value, components of the power supply being housed in the enclosure and subject to a vacuum which results within the enclosure by virtue of the enclosure being evacuated.

2. The apparatus of claim 1 wherein the power supply is selected from electrogasdynamic supply, a supply including a gas turbine driven generator or alternator, a supply including a piezoelectric generator, a supply including a triboelectric generator, a supply including a transformer for transforming AC line voltage variations and a multiplier, and a supply including a low voltage DC supply, an inverter, a transformer and a multiplier.

3. The apparatus of claim 1 wherein the power supply comprises a supply including a transformer and a multiplier.

4. The apparatus of claim 3 wherein the components of the power supply which are housed in the enclosure include the multiplier.

5. The apparatus of claim 1 wherein the electrostatic spray gun comprises a pistol grip-shaped handle and a barrel extending from the handle, the enclosure forming at least a part of the barrel.

6. An electrostatic spray gun including a power supply, an enclosure having a wall, a valve providing access through the wall to evacuate the enclosure, components of the power supply being housed in the enclosure and subject to the atmosphere within the enclosure, the enclosure filled with a medium consisting essentially of a high dielectric constant gas or high dielectric constant mixture of gases, the high dielectric constant gas or high dielectric constant mixture of gases being introduced into the enclosure after evacuation of the enclosure.

7. The apparatus of claim 6 wherein the high dielectric constant gas or high dielectric constant mixture of gases comprises sulfur hexafluoride.

8. The apparatus of claim 6 wherein the power supply is selected from electrogasdynamic supply, a supply including a gas turbine driven generator or alternator, a supply including a piezoelectric generator, a supply including a triboelectric generator, a supply including a transformer for transforming AC line voltage variations and a multiplier, and a supply including a low voltage DC supply, an inverter, a transformer and a multiplier.

9. The apparatus of claim 6 wherein the power supply comprises a supply including a transformer and a multiplier.

10. The apparatus of claim 9 wherein the components of the power supply which are housed in the enclosure include the multiplier.

11. The apparatus of claim 6 wherein the electrostatic spray gun comprises a pistol grip-shaped handle and a barrel extending from the handle, the enclosure forming at least a part of the barrel.

* * * * *

UNITED STATES PATENT AND TRADEMARK OFFICE

CERTIFICATE OF CORRECTION

PATENT NO. : 7,621,471 B2
APPLICATION NO. : 11/303322
DATED : November 24, 2009
INVENTOR(S) : Varce E. Howe It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 397 days.

Signed and Sealed this

Twenty-sixth Day of October, 2010

David J. Kappos

David J. Kappos
*Director of the United States Patent and Trademark Office*